US006281866B1

(12) United States Patent
Robinson et al.

(10) Patent No.: US 6,281,866 B1
(45) Date of Patent: Aug. 28, 2001

(54) DISPLAY DEVICE AND A METHOD OF ADDRESSING A DISPLAY DEVICE

(75) Inventors: Michael Geraint Robinson, Boulder, CO (US); Craig Tombling, Stadhampton; Nicholas Mayhew, Oxford, both of (GB)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/169,641

(22) Filed: Oct. 9, 1998

(30) Foreign Application Priority Data

Oct. 16, 1997 (GB) ..... 9721819

(51) Int. Cl.[7] ..... G09G 3/36
(52) U.S. Cl. ..... 345/87; 345/94; 345/97
(58) Field of Search ..... 345/87, 97, 96, 345/94, 88, 100

(56) References Cited

U.S. PATENT DOCUMENTS

| | | | | |
|---|---|---|---|---|
| 4,896,149 | * | 1/1990 | Busak et al. | 340/771 |
| 5,077,553 | * | 12/1991 | Busak | 340/771 |
| 5,182,665 | | 1/1993 | O'Callaghan et al. | 359/95 |
| 5,414,440 | * | 5/1995 | Ilcisin et al. | 345/87 |
| 5,420,604 | * | 5/1995 | Scheffer et al. | 345/100 |
| 5,485,173 | * | 1/1996 | Scheffer et al. | 345/100 |
| 5,546,102 | * | 8/1996 | Scheffer et al. | 345/100 |
| 5,648,792 | | 7/1997 | Sato et al. | 345/92 |
| 5,764,211 | * | 6/1998 | Tagawa et al. | 345/97 |
| 5,844,537 | * | 12/1998 | Bonnett et al. | 345/97 |

FOREIGN PATENT DOCUMENTS

| | | |
|---|---|---|
| 0526095 | 2/1993 | (EP) . |
| 0685832 | 12/1995 | (EP) . |
| 0811872 | 12/1997 | (EP) . |
| 2295479 | 5/1996 | (GB) . |
| 2312920 | 11/1997 | (GB) . |
| 03206188 | 9/1991 | (JP) . |
| 03206189 | 9/1991 | (JP) . |
| 06120324 | 4/1994 | (JP) . |

OTHER PUBLICATIONS

Search Report for EP Application No. 98308186.0–2205–; Dated Feb. 18, 1999.
Search Report for Application No. GB 9721819.2; Dated Feb. 11, 1998.
P.W.H. Surguy et al.; Ferroelectrics, pp. 63–79, 1991, "The 'Joers/Alvey' Ferroelectric Multiplexing Scheme".
J.R. Hughes et al.; Liquid Crystals, vol. 13, No. 4, pp. 597–601, 1993, "A New Set of High Speed Matrix Addressing Schemes for Ferroelectric Liquid Crystal Displays".
R.B. Apte et al.; Sid 93 Digest, pp. 807–808, 1993, "Deformable Grating Light Valves for High–Resolution Displays".
T. Ruckmongathan et al. "Active Addressing Method for High Contrast Video–Rate STN LCDs", 1992, pp. 228–231.*
T. Ruckmongathan et al "New Addressing Techniques for Multiplexed Liquid Crystal Display", 1983, pp. 259–262.*

* cited by examiner

*Primary Examiner*—Richard Hjerpe
*Assistant Examiner*—Ronald Laneau
(74) *Attorney, Agent, or Firm*—Renner, Otto, Boisselle & Sklar, LLP

(57) ABSTRACT

A display device includes a plurality of strobe electrodes and a plurality of pairs of data electrodes crossed with the strobe electrodes to define a respective pixel at each overlap of one of the strobe electrodes with one of the pairs of data electrodes. The display device further includes a strobe signal source for simultaneously supplying X different strobe signals to each group of X strobe electrodes in turn, where X is an integer greater than one, and a data signal source for supplying any one of a plurality of data signals to the data electrodes such that all combinations of optical states of the X pixels addressed by each group of strobe electrodes and each pair of data electrodes are selectable.

13 Claims, 6 Drawing Sheets

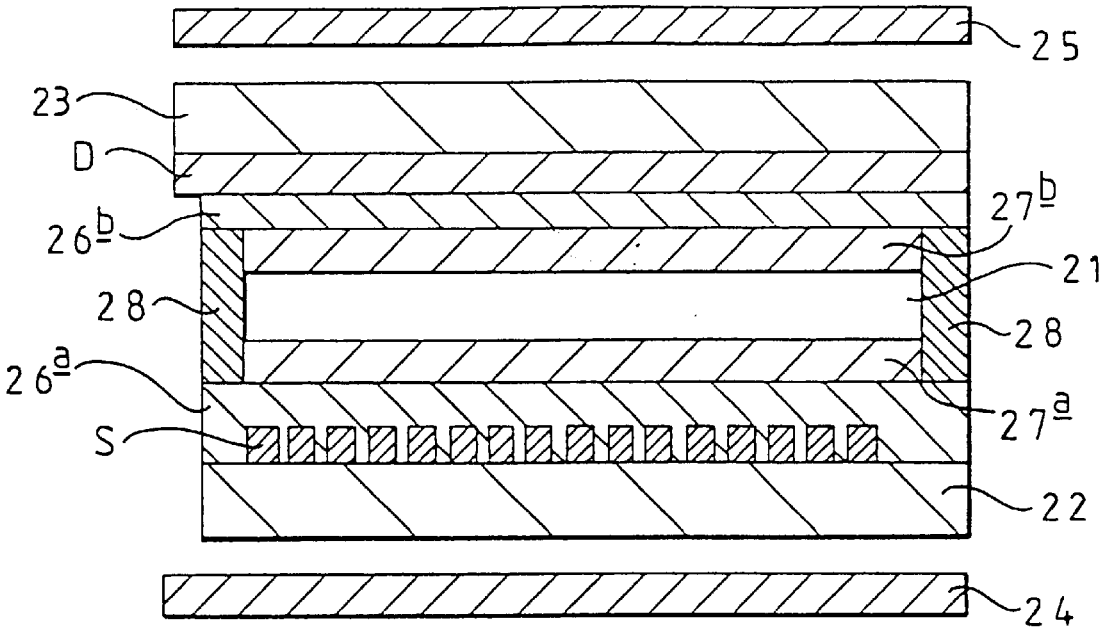
FIG 1
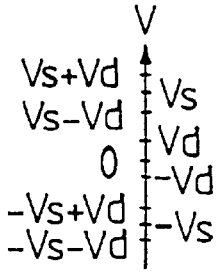
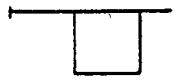
FIG 2(a)
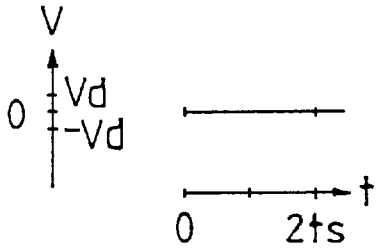
FIG 2(b)
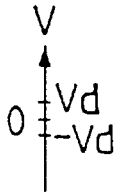
FIG 2(c)
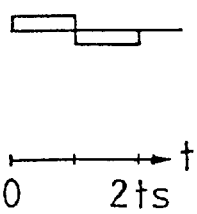
FIG 2(d)
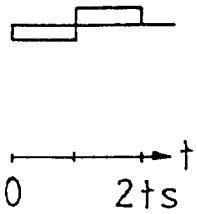

Data pulses (A, B)
Data driving circuit -29-
Shading indicates FLC states under electrodes
Si
Si+1
3a
3b
Data driving circuit -30-
Data pulses (C, B)
Strobe pulses
s1
s2
31
Strobe driving circuit Imaged pixel states
diffraction = white
no diffraction = black

DISPLAY DEVICE AND A METHOD OF ADDRESSING A DISPLAY DEVICE

TECHNICAL FIELD OF THE INVENTION

This invention relates to a display device in which two rows of picture elements (pixels) can be simultaneously addressed, and to a method of addressing such a display.

DISCUSSION OF THE RELATED ART

FIG. 1 is a schematic view of a liquid crystal display device disposed between two polarising plates 24, 25. The liquid crystal display device comprises a transparent substrate 22 on which are provided transparent strobe electrodes S (also known as row or scanning electrodes( which extend parallel to one another. An insulating layer 26*a* is provided over the strobe electrodes S, and an alignment film 27*a* is formed over the insulating layer. The alignment film 27*a* is spaced from a second alignment film 27*b* by spacers 28 and a liquid crystal layer 21. A second transparent substrate 23 carries transparent data electrodes D (also known as column electrodes), which are parallel to one another and which are perpendicular to the strobe electrodes. The alignment film 27*b* is formed over a second insulating layer 26*b* which itself is formed over the data electrodes D. The electrodes D, S are connected to a drive circuit (not shown).

A pixel Pij if defined by the overlap of the ith strobe electrode and the jth data electrode. In a passive addressing method, the pixel Pij is addressed by applying a strobe voltage to the ith strobe electrode while applying a data voltage to the jth data electrode. The voltage across the pixel is equal to the difference between the strobe voltage and the data voltage.

One example of the voltages that can be used in a method of passively addressing a liquid crystal display are the Joers/Alvey voltage waveforms (P. W. H. Surguy et al, "Ferroelectrics" 122 pp 63–79 (1991)). These voltages are used to drive a display device comprising a layer of ferroelectric liquid crystal (FLC) material which has two stable states—the drive voltage applied across a pixel will either switch the liquid crystal molecules in that pixel from one stable state to the other stable state, or it will not switch the liquid crystal molecules in that pixel.

One example of driving voltages according to the Joers/Alvey scheme is shown in FIGS. 2(*a*)–2(*d*). To address a display, a strobe driving circuit (not shown in FIG. 1) will apply a 'select' voltage pulse Vs shown in FIG. 2(*a*) to one strobe electrode, while applying the 'non-select' voltage pulse Vn (FIG. 2(*b*)) to the remaining strobe electrodes. The pixels in the selected row of the display are addressed by a data driving circuit (not shown in FIG. 1), which will apply either the 're-write' data voltage pulse $V_R$ (FIG. 2(*c*)) or the 'hold' data voltage pulse $V_H$ (FIG. 2(*d*))to the column electrodes. A pixel to which is applied the 'select' strobe voltage and the 'switch' data voltage will switch from one stable state of the FLC to the other stable state, and all other pixels will not switch. When a row of pixels is selected, the column electrodes can be addressed sequentially or simultaneously After one row of pixels has been addressed, the remaining rows are addressed, one after the other, in the same way.

It is a general object of workers in this field to increase the frame rate f of a display. The frame rate is given by:

$$F=1/tlb$$

where τ is the effective row address time, l the number of rows, and b the number of temporal bits required. If l and b are fixed, then the frame rate can only be increased by reducing τ. If two rows could be simultaneously addressed, then τ would, in principle, be halved.

A conventional passively addressed liquid crystal display, such as that shown in FIG. 1, could be operated in such a way that two rows of pixels were simultaneously addressed by applying a first select voltage Vs1 to one strobe electrode and a second select voltage Vs2 to another strobe electrode. However, this driving method would require four different data voltages. This is because two binary pixels (that is, two pixels each of which has two possible display states) together give four possible combined display states (the two states of each pixel are shown as 1 and 0).

| | data voltage | | | |
|---|---|---|---|---|
| | $V_1$ | $V_2$ | $V_3$ | $V_4$ |
| row 1: strobe voltage Vs1 | 0 | 1 | 0 | 1 |
| row 2: strobe voltage Vs2 | 0 | 0 | 1 | 1 |

Although addressing the device in this way would allow two rows of pixels to be addressed simultaneously, in practice, the line address time increases substantially and becomes approximately equal to twice the line address time where the pixels are addressed one row at a time. Accordingly, there is no substantial improvement in the frame rate of which the display is capable. Further, this technique has the disadvantage of doubling the number of distinct data voltages required. In general, the maximum number of possible combined display states for a column of pixels is equal to the number N of different data voltage waveforms that the driving data circuit can supply.

Display devices in which two scanning electrodes can be simultaneously driven are known. For example, JP-A-06 120 324 discloses a device in which a pixel is 'split' into three 'sub-pixels', with each sub-pixel having a separate scanning electrode. This is to provide a grey-scale display, by providing intermediate display states in which part of the pixel blocks light and part of the pixel transmits light.

In this prior art device, however, it is not possible to address the sub-pixels completely independently. It is only possible to address the following four combinations of sub-pixels: all sub pixels; the first and second sub-pixels; the first sub-pixels; or none of the sub-pixels. It is not possible, for example, for the first and third sub-pixels to be 'ON' when the second sub-pixel 2 is 'OFF'.

Other devices in which a pixel comprises two sub-pixels each having its own scanning electrode are displayed in JP-A-3 206 188 and JP-A-3 206 189. It is again not possible to address the two sub-pixels completely independently from one another in these prior art devices.

SUMMARY OF THE INVENTION

According to a first aspect of the invention, there is provided a display device comprising a plurality of strobe electrodes characterised by:

- a plurality of pairs of data electrodes crossed with the strobe electrodes to define a respective pixel at each overlap of one of the strobe electrodes with one of the pairs of data electrodes;
- a strobe signal source for simultaneously supplying X different strobe signals to each group of X electrodes in turn, where X is an integer greater than one; and
- a data signal source for supplying any one of a plurality of data signals to the data electrodes such that all combinations of optical states of the X pixels addressed by each group of strobe electrodes and each pair of data electrodes are selectable.

According to a second aspect of the invention, there is provided a method of addressing a display device of the type comprising a plurality of strobe electrodes and a plurality of data electrodes crossed with the strobe electrodes to define a respective pixel at each overlap of one of the strobe electrodes with one of the pairs of data electrodes, the method comprising the steps of:

simultaneously supplying X different strobe signals to each group of X strobe electrodes in turn, where X is an integer greater than one; and supply any one of a plurality of data signals to the data electrodes such that all combinations of optical states of the X pixels addressed by each group of strobe electrodes and each pair of data electrodes are selectable.

It has been surprisingly found that the use of pairs of data electrodes for each pixel allows multiple strobing of image data to the pixels at an increased frame rate. In particular, strobing several rows at a time is possible with a line address time which may be greater than that required when strobing a single row at a time but which is less than the sum of the line address times which would be required to refresh the rows individually. For instance, where X is equal to tow so that two rows are refreshed at a time, the time required to address and refresh the two rows is less than twice the time which would be required to address and refresh the rows sequentially. The effective line address time is therefore reduced allowing the maximum frame rate to be increased. For displays of the type which, in any case, require two data electrodes to address each pixel, there is no penalty in terms of the cost and complexity of manufacture.

The X pixels addressed by each group of strobe electrodes and each pair of data electrodes may have M combinations of optical states, the data signal source may be arranged to supply any one of N data signals to a first data electrode of each pair and simultaneously to supply any one of the N data signals to a second data electrode of each pair and M may be greater than N.

Such an arrangement allows the display device to display more combined display states than the number of data signals that the data signal source can supply. This enables the number of data signals that are required to drive, for instance, two rows of pixels simultaneously to be reduced.

X may be equal to two and the strobe signal source may be arranged to supply a first strobe signal to each first strobe electrode of the groups and a second strobe signal, which is of the same waveform and amplitude as but of polarity opposite that of the firs strobe signal, to each second strobe electrode of the groups.

Such an arrangement allows the strobe signal source to be simplified. In particular, half the number of strobe signal drivers are required as compared with conventional strobe signal sources which strobe each row in turn. The other drivers which would conventionally be required can be replaced by inverters so that the cost and complexity of the strobe signal source may be reduced.

The data signal source may apply, in use, either a first data signal or a second data signal to the first data electrode and may simultaneously apply either a third data signal of the second data signal to the second data electrode and M may be equal to four. The second data signal may be a zero voltage. This enables the data signal source to be simplified, as only two non-zero voltage waveforms are required. Each pixel may be switchable between a first optical state and a second optical state. As two binary pixels can provide four different combined display states, these embodiments of the invention allow two rows of binary pixels to be driven simultaneously using only three data signals. The display device may be a diffractive spatial light modulator, and in the first optical state a pixel may diffract light and in the second optical state a pixel may transmit light or specularly reflect light. Such a modulator can have high resolution picture element and a display device having such a modulator has good reliability, a long life, and provides an image having good contrast and high intensity.

Each pair of data electrodes may comprise a plurality of elongate parallel first electrode portions and a plurality of elongate parallel second electrode portions interdigitated with the first electrode portions.

The display device may be a liquid crystal display device.

DESCRIPTION OF THE DRAWINGS

Preferred embodiments of the invention will now be described, by way of illustrative example, with reference to the accompanying Figures in which:

FIG. 1 is a schematic structural view of a conventional liquid crystal display device;

FIGS. 1(*a*) to 2(*d*) show prior art strobe voltages for driving a liquid crystal display device having a ferroelectric liquid crystal;

FIG. 6(*b*) is a partial enlarged view of FIG. 6(*a*);

DETAILED DESCRIPTION OF THE INVENTION

Figure 3:
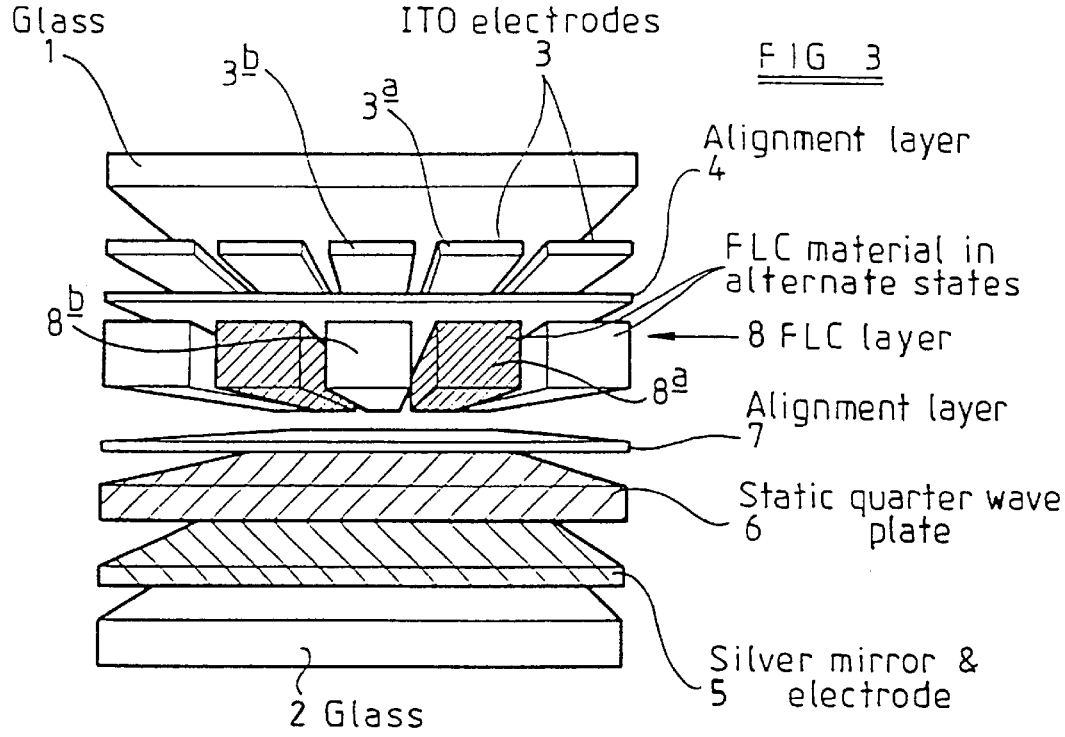
FIG. 3 is an exploded view of a reflective mode, diffractive spatial light modulator (SLM) of the type described in CB 2 312 920 and EP 0 811 872.
Figure 4:
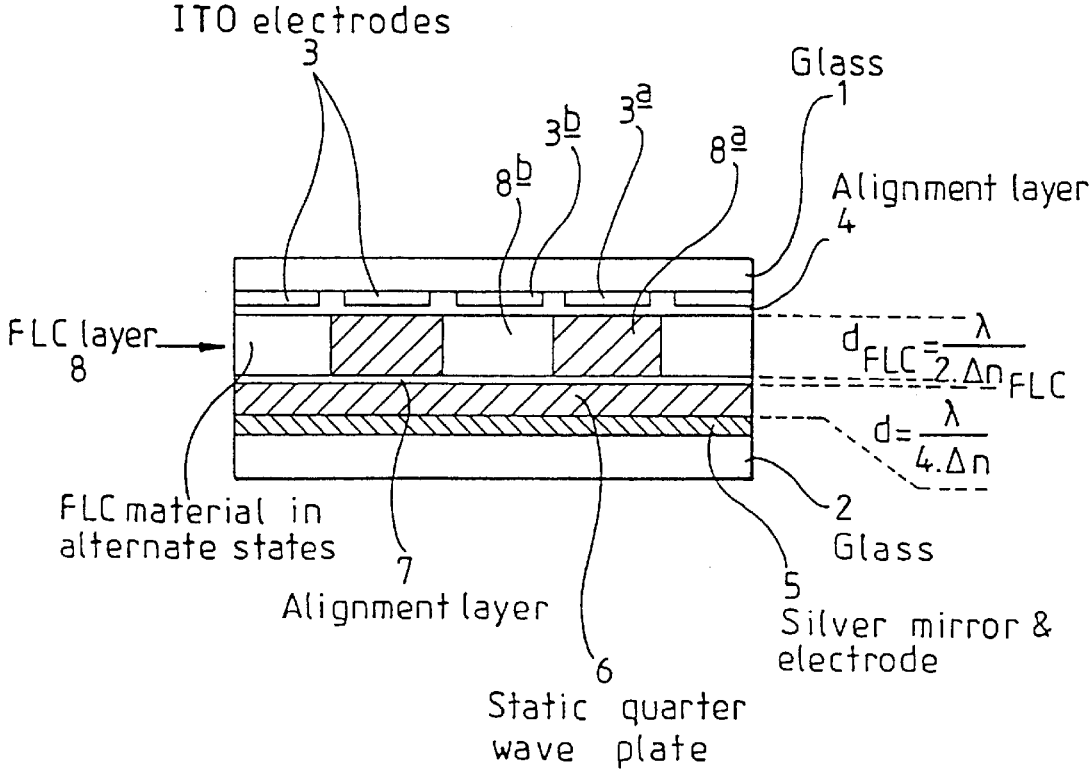
FIG. 4 is a cross-sectional view of the SLM of FIG. 3.

FIGS. 3 and 4 show a reflection-mode diffractive spatial light modulator (SLM). The SML comprises a rectangular array of rectangular or substantially rectangular picture elements (pixels), only one of which is shown in FIGS. 3 and 4. The SLM comprises upper and lower glass substrates 1 and 2. The upper substrate 1 is coated with a transparent conducting layer of indium tin oxide (ITO) which is etched to form elongate interdigitated electrodes 3. The electrodes 3 are covered with an alignment layer 4 for a ferroelectric liquid crystal material. In particular, the alignment layer 4 is formed by obliquely evaporating silicon oxide at 84 degrees to the normal to the substrate 1 so as to induce the C1 state in a ferroelectric liquid crystal material, for instance of the type known as SCE8 available from Merck. For instance, the alignment layer 4 may have a thickness of approximately 10 nanometres. A combined mirror armed electrode 5 is formed on the class substrate 2 by depositing silver to a thickness of approximately 100 nanometres. A static quarter wave plate 6 is formed on the silver mirror and electrode 5. The quarter wave plate 6 may be provided by springing on a mixture of a reactive mesocen RM257 in a suitable solvent such as a toluene/xylene mixture with a photoinitiator, This is cured for approximately ten minutes under ultraviolet light in an atmosphere of nitrogen. The thickness of the plate 6 is controlled, for instance by varying the mix ratios of the materials and the spin speed, so that it acts as a quarter wave plate for a predetermined bandwidth in the visible spectrum, for instanced centered about 520 nanometres. The thickness d is given by the expression $$d=\lambda/4.\Delta n$$

where $\lambda$ is the wavelength of the centre of the band and $\Delta n$ is the difference between ordinary and extraordinary refractive indices of the material of the quarter wave plate 6. The quarter wave plate 6 therefore typically has a thickness of the order of 800 nanometres.

A further alignment layer 7 is formed on the quarter wave plate 6, for instance as described hereinbefore for the alignment layer 4. The substrates 1 and 2 are then spaced apart, for instance by spacer balls of two micrometre diameter, and stuck together so as to form a cell which is filled with the ferroelectric liquid crystal material to form a layer 8. The spacing provides a layer of ferroelectric liquid crystal material which provides a half wave of retardation so that the liquid crystal layer acts as a half wave retarder whose optic axis is switchable as described hereinafter. In particular, the ferroelectric liquid crystal layer has a thickness d given by $$d=\lambda.266\ n_{FLC}$$

where $\Delta n_{FLC}$ is the difference between the ordinary and the extraordinary refractive indices of the ferroelectric liquid crystal material.

In order to optimise the brightness of the display, the reflectivity of each interface should preferably be educed, for instance by applying anti-reflection coatings to the substrate 1 and by optionally burying the electrodes 3.

The electrodes 3 and 11 are arranged to provide for suitable addressing of the pixels of the SLM. For instance, in a passive matrix addressing arrangement, the electrodes 3 may extend throughout the length of the SLM and may be connected to the outputs of a data signal generator for supplying a row of pixel data at a time to the pixels. The electrode 5 may be extended transversely to form a row electrode connected to the output of a strobe signal generator for strobing the data to the SLM a row at a time in a repeating sequence.

For each pixel, the electrode 5 acts as a common electrode which is connectable to a reference voltage line, for instance supplying zero volts, for strobing data to be displayed at the pixel. Alternate ones of the elongate electrodes 3 are connected together to form two sets of interdigitated electrodes which arc connected to receive suitable data signal. Each pixel is switchable between a reflective state and a diffractive state as described hereinafter.

Figure 5:
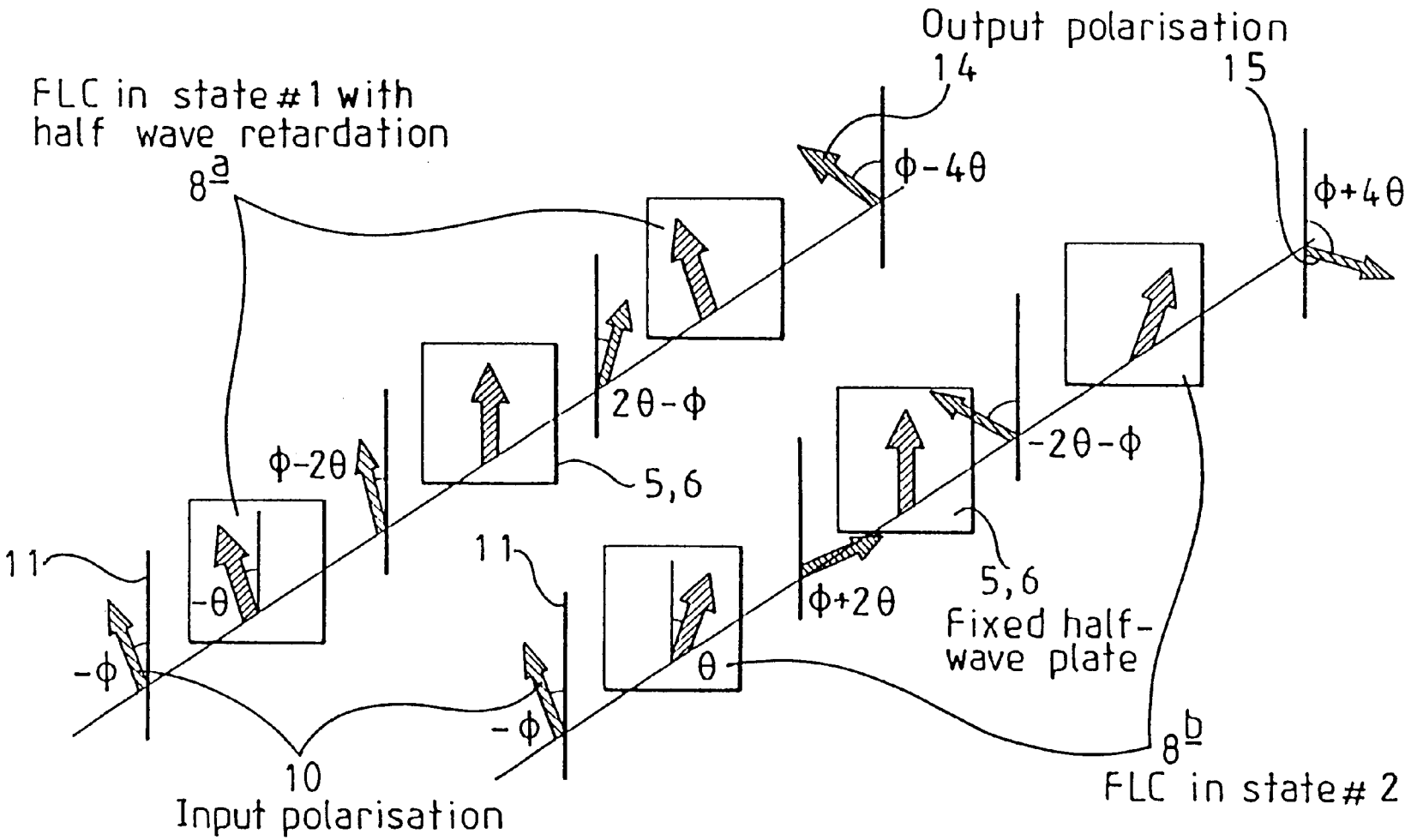
FIG. 5 is a diagram illustrating the operation of the SLM of FIGS. 3 and 4.

FIG. 5 illustrates diagrammatically the operation of adjacent strips of the pixel shown in FIGS. 3 and 4 when the pixel is in the diffractive mode. The optical path through each pixel is folded by reflection at the mirror 5 but, for the sake of clarity, the path is shown unfolded in FIG. 5. The SLM acts on unpolarised light, which may be split into components of orthogonal polarisations for the sake of describing operation of the SLM. One of the component polarisations is shown at 10 in FIG. 5 and is at an angle $-\phi$with respect to a predetermined direction 11.

Voltages which are symmetrical with respect to the reference voltage on the electrode 5 are applied to the two sets of alternating interdigitated electrodes 3*a* and 3*b*. Thus, ferroelectric liquid crystal material strips 8*a* and 8*b* disposed between the electrodes 3*a* and 3*b* and the electrode 5 have optic axes aligned at angles of $-\theta$ and $+\theta$, respectively, with respect to the direction 11, where $\theta$ is preferably approximately equal to 22.5 degrees.

Each strip 8*a* of ferroelectric liquid crystal material acts a half wave retarder so that the polarisation of the light component leaving the strip 8*a* is at an angle of $\phi-2\theta$ with respect to the direction 11. The light component then passes through the static quarter wave plate 6, is reflected by the mirror 5, and again passes through the static quarter wave plate 6, so that the combination of the quarter wave plate 6 and the mirror 5 acts as a half wave retarder whose optic axis is parallel to the direction 11. The polarisation direction of light leaving the quarter wave plate 6 and travelling towards the ferroelectric liquid crystal is "reflected" about the optic axis of the quarter wave plate 6 and thus forms an angle $2\theta-\phi$ with respect to the direction 11. The light component than again passes through the strip 8*a* of ferroelectric liquid crystal material sot hat the output polarisation as shown at 14 is at an angle of $\phi-4\theta$ with respect to the direction 11. Thus, for each input component of arbitrary polarisation direction $-\phi$, the optical path through the SLM via each of the strips 8*a* of ferroelectric liquid crystal material is such that the polarisation direction is rotated by $-4\theta$. This optical path therefore rotates the polarisation of unpolarised light by $-4\theta$, which is substantially equal to $-90$ degrees.

Each strip 8*b* of ferroelectric liquid crystal material acts as a half wave retarder and rotates the polarisation direction to $\phi+2\theta$. The fixed half wave retarder formed by the combination of the quarter wave plate 6 and the mirror 5 rotates the direction of polarisation of the light component so that it makes an angle of $-2\theta-\phi$ with respect to the direction 11. The final passage through the strip 8*b* rotates the polarisation direction to $\phi+4\theta$ as shown at 15. Thus, unpolarised light passing through the strips 8*b* has its polarisation rotated by $+4\theta$, which is substantially equal to $+90$ degrees.

Light reflected through each of the strips 8*b* is out of phase by 180 degrees with respect to light passing through each of the strips 8*a* when the electrodes 3*b* and 3*a* are connected to receive data signals of opposite polarity. In this state, the pixel acts as a phase-only diffraction grating, and the pixel operates in the diffractive mode. Because of the bi-stable characterstics of ferroelectric liquid crystals, it is necessary only to supply the data signals in order to switch the strips 8*a* and 8*b* to the different modes illustrated in FIG. 5.

In order for the pixel to operate in the reflective mode, it is necessary to switch either or both sets of strips 8*a* and 8*b* so that their optic axes are parallel. Unpolarised light incident on the pixel is then substantially unaffected by the ferroelectric liquid crystal material and the quarter wave plate 6 and is subjected to specular reflection by the mirror and electrode 5. Each pixel is therefore switchable between a transmissive mode, in which light is specularly reflected or "deflected" into the zeroth diffraction order, and a diffractive mode, in which light incident on the pixel is deflected into the non-zero diffractive orders.

This diffractive SLM is further described in GB 2 312 920 and EP 0 811 872.

Figures 6A, 6B:
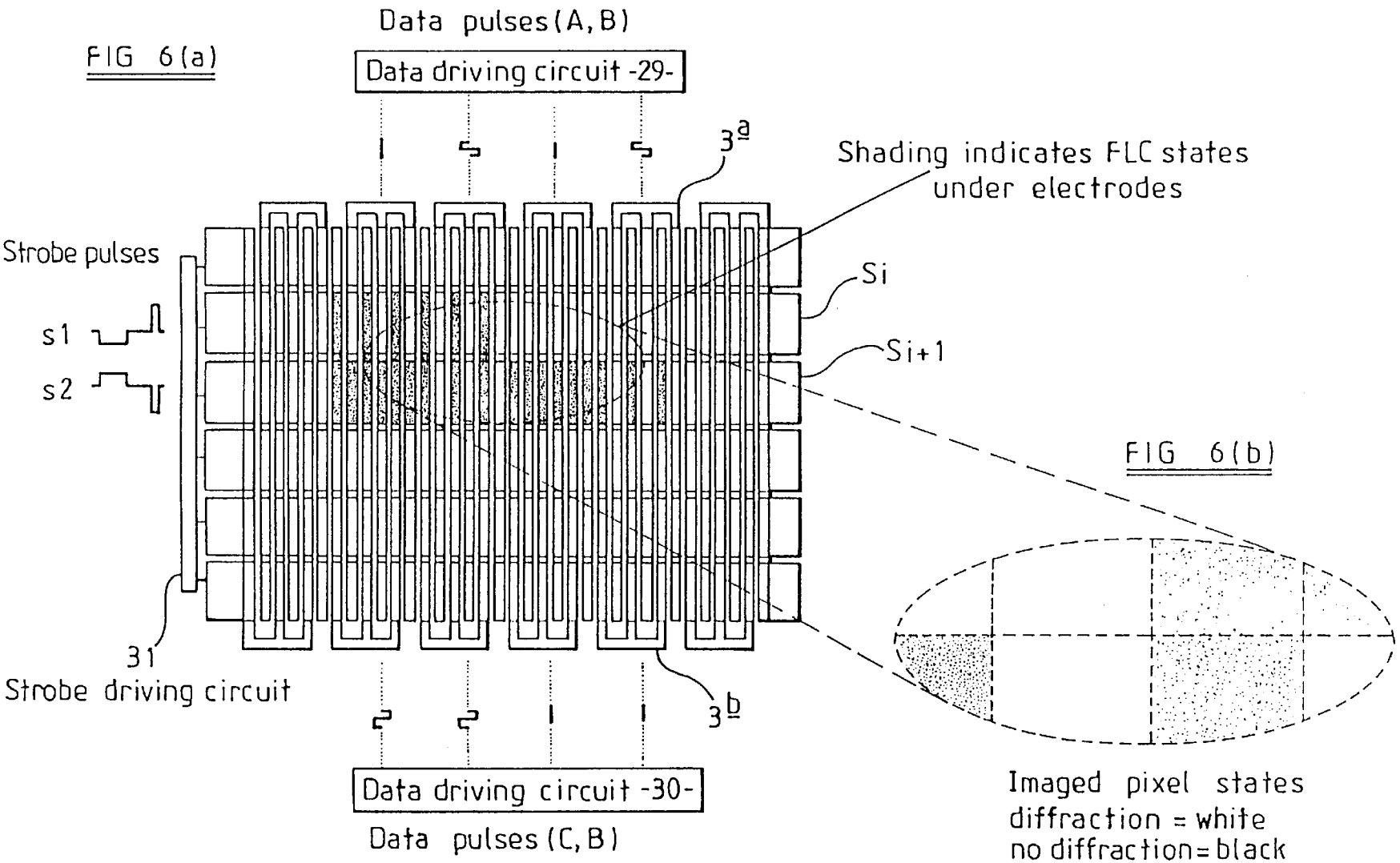
FIG. 6(*a*) is a plan view of the SLM of FIGS. 3 and 4.
Figure 7A:
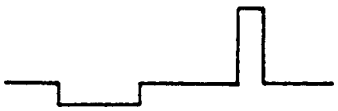
FIGS. 7 (*a*) to 7 (*d*) show strobe voltage pulses and data voltage pulses for driving the SLM of FIGS. 3 and 4 according to the method of the present invention.
Figure 7B:
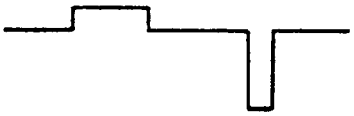
Figure 7C:
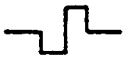
Figure 7D:
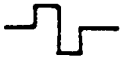

FIG. 6(*a*) is a schematic plan view of the SLM of FIGS. 3–5. Each pixel has a column electrode which consists of two sets of interdigitated electrodes 3*a*, 3*b*. These are driven by data driving circuits 29, 30. A strobe driving circuit 31 applies strobe voltages to the row electrodes.

Suppose that the input to one set of electrodes 3*a* can be either of two voltage pulses A or B, and that the input to the other set of electrodes 3*b* can be either of two voltage pulses C or D. Since the column electrode of a pixel is made up of the two interdigitated electrodes, there are now four possible inputs to the column electrode of a pixel –A to one electrode and C to the other electrode (AC), A to one electrode and D to the other electrode (AD), B to one electrode and C to the other electrode (BC) or B to one electrode D to the other electrode (BD). These four possible data voltage combinations make it possible to address two rows of pixels simultaneously. In fact, the addressing scheme can be simplified by making voltage B equal to voltage D, as this still gives rise to 4 possible data voltage combinations –AB, AC, CB, BB.

In an extension of a conventional Joers/Alvey (J-A) scheme for addressing a display having an FLC, two different 'select' strobe pulses are required if two strobe electrodes are to be addressed simultaneously (otherwise the two rows of pixels would display the same image data). In this example, the second 'select' strobe voltage is a voltage pulse Vs2 which is equal in magnitude but opposite in polarity to the first 'select' strobe voltage Vs1. The voltage pulses S1 and S2 are shown in FIGS. 7(*a*) and 7(*b*) respectively.

The usual data pulses used in the J-A scheme are opposite polarity, two slot bipolar pulses which, when applied to the jth data electrode at the same time as a strobe voltage pulse is applied to tie ith row electrode, will produce a voltage across pixel $P_{ij}$ that either switches or does not switch the FLC. These known data voltage pulses can be chosen as part of the addressing set (voltage pulses A and C referred to above) since they offer known switching discrimination. By their nature, they act in an opposite manner on the FLC when combined with the opposite polarity strobe pulses. For example, one of the data pulses, A, (FIG. 7(*c*)) would completely switch the FLC with one strobe pulse S1, and would not switch the FLC with the other strobe pulse S2 (and vice versa for the other data pulse, C (FIG. 7*d*)). To complete the set a suitable third data pulse, B, must be chosen that has no FLC switching discrimination when combined with either of the strobe pulses. That is, the data pulse B would have the same switching effect on the FLC with either of the strobe pulses S1 or S2. Such a data pulse could be a zero voltage pulse which can be made either to switch the FLC for either strobe pulse or, more favourably (in terms of overall panel address time), not to switch the FLC for either strobe pulse. By using the strobe and data pulses shown in FIGS. 7(*a*) to 7(*d*) and a zero voltage data pulse, all four combined pixel states can be obtained, as shown in FIG. 8.

Figure 8:
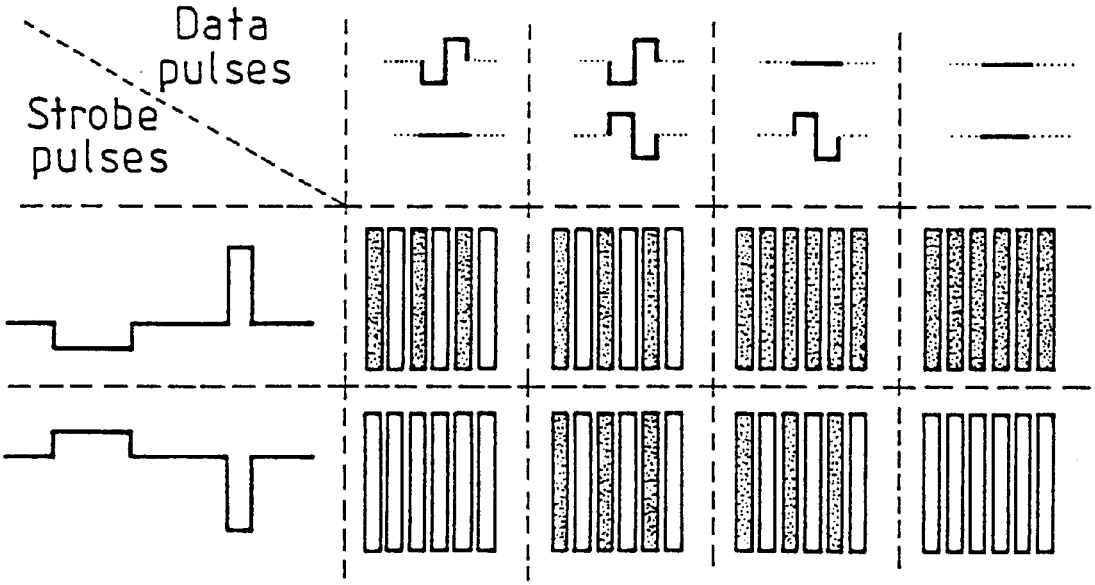
FIG. 8 shows the possible states of the SLM of FIGS. 3 and 4 when driven with the voltages of FIG. 7.

In FIG. 8 the voltage pulses are shown together with the states (indicated by black or white) of the FLC under the interdigitated electrodes. Where the FLC under one column electrode 3*a* and the FLC under the other column electrode 3*b* are in different states, a diffraction grating is set up and the pixel can be considered ON; when the FLC under one column electrode 3*a* and the FLC under the other column electrode 3*b* are in the same state, the pixel is OFF. (It should be noted that the use of black and white in FIG. 8 does not me in that the liquid crystal blocks light in the areas shaded in black and transmits light in the regions shown in white. This also applies to FIG. 6(*a*). The pixels are shown in FIG. 6(*b*) as they would appear to an observer.)

From FIG. 8 it can be seen that the states of the FLC under this addressing scheme are not equally likely to b accessed, which could possibly result in damage to the material due to internal, non d.c. balanced, electric fields. To avoid this, the polarity of all pulses could be changed frame by frame (or even line by line) without any effect on the resulting optical performance of the display. This is a general advantage of this type of SLM in which the reversal of the state of the FLC does not reverse the optical state of the pixel.

Figure 9A:
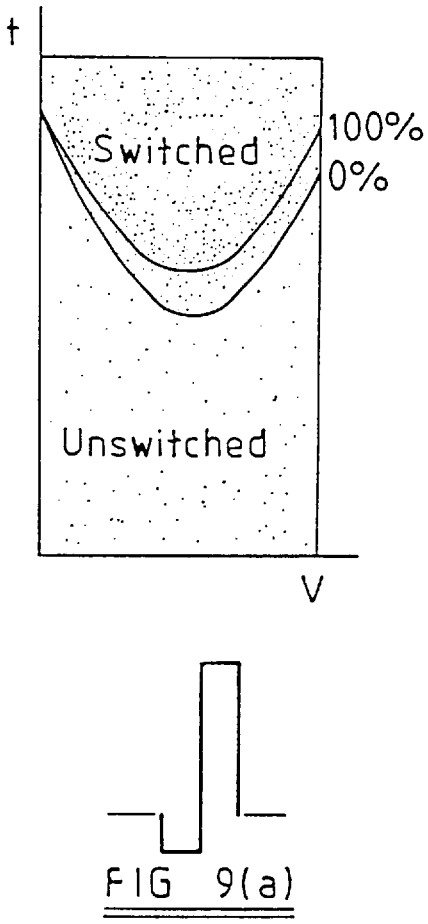
FIGS. 9(*a*), 9 (*b*) and 9(*c*) show switching characteristics of a ferroelectric liquid crystal for voltage pulses of three different shapes.
Figure 9B:
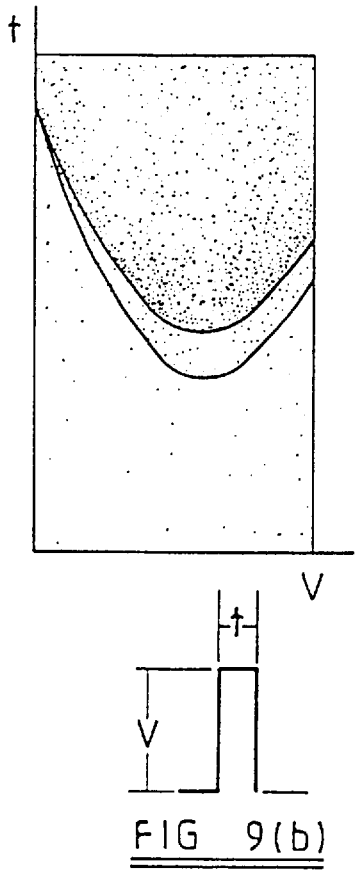
Figure 9C:
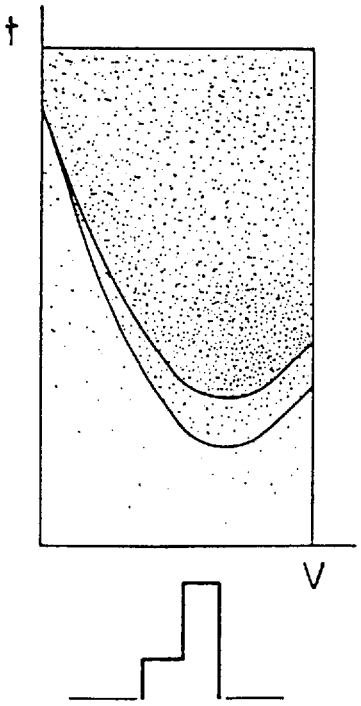
Figure 10:
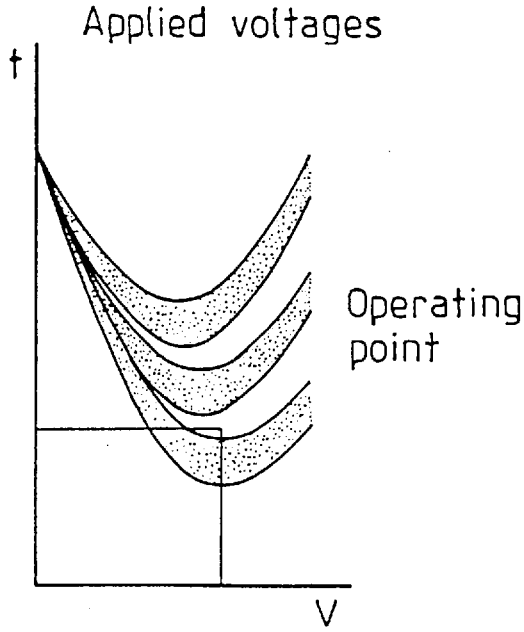
FIG. 10 shows the characteristic curves of FIGS. 9(*a*), 9(*B*) and 9(*c*) superimposed on one another.

The switching charateristics of an FLC are shown, for three differently shaped voltage pulses, in FIGS. 9(*a*) to 9(*c*). It can be seen that, for a fixed data voltage pulse, there is a region where the combination of the strobe voltage and the slot time does not cause switching, a region where 100% switching occurs and a region where partial switching occurs. For pixels to switch under the influence of one of the bipolar data pulses with one of the strobe pulses, but not to switch under the influence of the opposite bipolar data pulse with the same strobe pulse, the display must be operated such that the partial switching regions are completely separate, so that one resultant waveform will cause no switching and the other resultant waveform will cause 100% switching (no partial switching). One possible operating point is shown in FIG. 10, in which the partial switching regions of FIGS. 9(*a*) to 9(*c*) are superimposed. This is required for conventional passive addressing of FLC displays.

The introduction of a zero voltage data pulse for addressing purposes means that the 0%/100% curves associated with just the strobe pulse (which will be the voltage experienced by a pixel when the data voltage is the zero voltage pulse B) must be separate, and must be between the similar curves for non-zero data pulses to maintain the FLC switching integrity (that is, to prevent partial switching). In general this is the case, but the extent to which the curves are separate is reduced when compared with a conventional J/A addressing scheme. This has the effect of reducing the drive window such that non-uniformity in the panel and temperature variation resulting in small shifts of these curves could cause addressing problems.

One advantage of this display is that it can operate with no increase in slot time compared to the usual addressing scheme. This means in principle that the frame rate should be doubled by using this addressing technique over conventional panels. Since the size of projections panels is small and they are typically operated within a controlled environment, device tolerances can be reduced allowing full benefit of the increased addressing rate.

Other FLC based embodiments of the present invention could use extensions of other known addressing schemes, for example such as the Malvern-3 addressing method (J. R. Hughes and E. P. Raynes, "Liquid Crystals" 13 pp597–601, 1993).

In another embodiment, the C2 liquid crystal alignment is used, This differs from the previously described embodiment in that the alignment layers 27*a* and 27*b* comprise low pretilt polyamide alignment layers, for example formed by spin-coating PI2555 (available from Dupont) to a depth of approximately 100 nanometres or less. Also, the ferroelectric liquid crystal of the layer 21 has a chiral smetic C phase, a τ-Vmin characteristic, spontaneous polarisation less than 20 n/C/cm$^2$, a cone angle of between 10° and 45° and preferably of 22.5°, and positive dielectric biaxiality.

This embodiment may use a quarter cycle, phase shifted bipolar signal similar to the two slot data pulses. In this case, there are again constraints on the voltage as its associated switching curve would bisect the conventional data switching curves, as in the zero volt case. However, there would be the advantage that stabilising would be improved as the RMS a.c. voltage across the FLC would be maintained.

Good stabilisation improves the brightness of a diffractive SLM panel as it increases the switching angle which, for currently available addressable materials, is typically found to be lower than the ideal angle (45°).

The data pulses provide an a.c. waveform at the non-selected rows and this causes the FLC to be driven to a higher angle state closer to the cone angle of the material. This may be beneficial In achieving the required switched angle for maximising light throughput.

Other FLC embodiments include an alternative non-discriminating data voltage pulse (i.e., voltage B), such as higher frequency, high voltage bipolar voltage signal. In this case the switching curve would exist above the two curves associated with conventional addressing methods (due to increased a.c. stabilisation) and the improvement in the line address time would be expected to be a factor of two over the fundamental limit when employing strobe extension.

The present invention is not limited to FLC displays. For example, it can be applied to other liquid crystal displays such as a display having a super twisted nematic (STN) liquid crystal. In one simple addressing scheme that could be used with an STN display, the three data voltages could simply be a positive pulse, a negative pulse, and a zero voltage pulse. The two strobe pulses would be of opposite polarity to one another. The four possible display states of two pixels would be generated as follows:

| | | data Voltage | | | |
|---|---|---|---|---|---|
| | | a = + b = + | a = + b = − | a = o b = + | a = o b = − |
| Pixel 1 | Strobe + | ON | ON | OFF | OFF |
| Pixel 2 | Strobe − | OFF | ON | OFF | ON |

This table is compiled on the basis that:

a positive data pulse and a positive strobe pulse puts the liquid crystal in the first state;

a negative data pulse and a negative strobe pulse Puts the liquid crystal in the first state; and all other combinations put the liquid crystal in a second state.

When the liquid crystal portions under one column electrode in a pixel are in a different state from the liquid crystal portions under the second column electrode, a diffraction grating is set up and the pixel is 'ON' (light is diffracted out and can be used to display an image). If the liquid crystal portions under the two column electrodes are in the same state, then there is not diffraction grating and so the pixel is 'OFF'.

It is possible to use an AFLC (anti-ferroelectric liquid crystal) in a passively addressed device. In this case, the more typical hysteretic AFLC voltage-transmissivity relationship is required. This mode has similar optical characteristics to the FLC mode described hereinbefore and is capable of achieving analogue or grey level operation through domain growth. A possible passive AFLC addressing mode uses resetting to the pair of ferroelectric states to provide equivalence to the FLC operation.

A modulator of the type described hereinbefore may also be embodied using a bistable twisted nematic (BTN) liquid crystal in an active matrix addressing arrangement. For approximately twice the cell gap in an anti-parallel aligned produces a splayed 180° twist state and two splayed metastable states with 0° and 360° twist. The two metastable state provide a bistable mode of operation for the liquid crystal. The liquid crystal can be switched between the metastable states by applying a reset pulse, which produces a temporary homeotropic state. The metastable states may be rapidly accessed and represent the bistable states. Two-line addressing of such a BTN mode modulator can be performed similarly of the STN mode described hereinbefore with the reset pulse on both rows restoring an OFF state.

Moreover, the method of this invention is not limited to liquid crystal displays, but it can be applied to other passively addressed, pixelated display devices in which a pixel has two independent column electrodes. For example, it could be applied, in principle, to the 'Deformable Grating Light Valve' disclosed in SID 1993, pp 807–8, Apte et al.

What is claimed is:

1. A diffractive spatial light modulator, comprising:

a plurality of strobe electrodes;

a plurality of pairs of data electrodes crossed with the strobe electrodes to define a respective pixel at each overlap of one of the strobe electrodes with one of the pairs of data electrodes;

a strobe signal source for simultaneously supplying X different strobe signals to each group of X strobe electrodes in turn, where X is an integer greater than one; and a data signal source for supplying any one of a plurality of data signals to the data electrodes such that all combinations of optical states of the X pixels addressed by each group of strobe electrodes and each pair of data electrodes are selectable, wherein each pixel is switchable between a first optical state in which the pixel diffracts light, and a second optical state in which the pixel transmits light or specularly reflects light.

2. A display device as claimed in claim 1, wherein the X pixels addressed by each group of strobe electrodes and each pair of data electrodes have M combinations of optical states, the data signal is arranged to supply any one of N data signals to a first data electrode of each pair and simultaneously to supply any one of the N data signals to a second data electrode of each pair, and M>N.

3. A display device as claimed in claim 1, wherein X=2 and the strobe signal source is arranged to supply a first strobe signal to each first strobe electrode of the groups and a second strobe signal, which is of the same waveform and amplitude as, but of polarity opposite that of, the first strobe signal, to each second strobe electrode of the groups.

4. A display device as claimed in claim 1, wherein each pair of data electrodes comprises a plurality of elongate parallel first electrode portions and a plurality of elongate parallel second electrode portions interdigitated with the first electrode portions.

5. A display device as claimed in claim 1, comprising a liquid crystal display device.

6. A modulator as claimed in claim 1, wherein each pair of data electrodes comprises a plurality of elongate parallel first electrode portions and a plurality of elongate parallel second electrode portions interdigitated with the first electrode portions.

7. A modulator as claimed in claim 1, wherein the modulator comprises liquid crystal material interposed between the overlapping strobe electrode and the pair of data electrodes at each pixel.

8. A display device, comprising:

a plurality of strobe electrodes;

a plurality of pairs of data electrodes crossed with the strobe electrodes to define a respective pixel at each overlap of one of the strobe electrodes with one of the pairs of data electrodes;

a strobe signal source for simultaneously supplying X different strobe signals to each group of X strobe electrodes in turn, where X is an integer greater than one; and a data signal source for supplying any one of a plurality of data signals to the data electrodes such that all combinations of optical states of the X pixels addressed by each group of strobe electrodes and each pair of data electrodes are selectable, wherein the X pixels addressed by each group of strobe electrodes and each pair of data electrodes have M combinations of optical states, the data signal source is arranged to supply any one of N data signals to a first data electrode of each pair and simultaneously to supply any one of the N data signals to a second data electrode of each pair, and M>N, and the data signal source applies, in use, either a first data signal or a second data signal to the first data electrode and simultaneously applies either a third data signal or the second data signal to the second data electrode and in that M=4.

9. A display device as claimed in claim 8, wherein the second data signal is a zero voltage.

10. A display device as claimed in claim 8, wherein each pixel is switchable between a first optical state and a second optical state.

11. A display device as claimed in claim 10, wherein the display device is a diffractive spatial light modulator and in that in the first optical state a pixel diffracts light and in the second optical state a pixel transmits light or specularly reflects light.

12. A method of addressing a diffractive spatial light modulator of the type comprising a plurality of strobe electrodes and a plurality of data electrodes crossed with the strobe electrodes to define a respective pixel at each overlap of one of the strobe electrodes with one of the pairs of data electrodes, the method comprising the step of:

simultaneously supplying X different strobe signals to each group of X strobe electrodes in turn, where X is an integer greater than one; and supplying any one of a plurality of data signals to the data electrodes such that all combinations of optical states of the X pixels addressed by each group of strobe electrodes and each pair of data electrodes are selectable in order to switch each pixel between a first optical state in which the pixel diffracts light, and a second optical state in which the pixel transmits light or specularly reflects light.

13. A method as claimed in claim 12, wherein each pair of data electrodes comprises a plurality of elongate parallel first electrode portions and a plurality of elongate parallel second electrode portions interdigitated with the first electrode portions.

* * * * *